US005417087A

United States Patent [19]

Marcello, Baseggio

[11] Patent Number: 5,417,087

[45] Date of Patent: May 23, 1995

[54] FLAT-BED KNITTING MACHINE

[75] Inventor: Marcello, Baseggio, Ollon, Switzerland

[73] Assignee: Atelier de Construction Steiger S.A., Vionnaz, Switzerland

[21] Appl. No.: 110,439

[22] Filed: Aug. 23, 1993

Related U.S. Application Data

[63] Continuation-in-part of Ser. No. 919,550, Jul. 22, 1992, abandoned.

[30] Foreign Application Priority Data

Aug. 2, 1991 [CH] Switzerland ..... 2299/91

[51] Int. Cl.[6] ..... D04B 7/00

[52] U.S. Cl. ..... 66/64; 66/60 R

[58] Field of Search ..... 66/60 R, 64, 60 H, 62, 66/78, 126 R

[56] References Cited

U.S. PATENT DOCUMENTS

| | | | |
|---|---|---|---|
| 3,733,856 | 5/1973 | Shima | 66/62 |
| 4,192,156 | 3/1980 | Kohler | 66/64 |
| 4,640,103 | 2/1987 | Schieber | 66/64 |
| 4,724,685 | 2/1988 | Stoll et al. | 66/64 |
| 5,014,524 | 5/1991 | Smilovici | 66/64 |
| 5,031,423 | 7/1991 | Ikenaga | 66/126 R |

FOREIGN PATENT DOCUMENTS

| | | | |
|---|---|---|---|
| 276383 | 8/1988 | European Pat. Off. | 66/64 |
| 0244774 | 4/1987 | German Dem. Rep. | 66/64 |
| 2415886 | 10/1975 | Germany . | |
| 8424135 | 4/1988 | Germany . | |
| 2123158 | 2/1986 | United Kingdom | 66/64 |

*Primary Examiner*—Clifford D. Crowder
*Assistant Examiner*—Larry D. Worrell, Jr.
*Attorney, Agent, or Firm*—Kane, Dalsimer, Sullivan, Kurucz, Levy, Eisele and Richard

[57] ABSTRACT

The machine comprises two knitting beds (2, 3) and at least one pair of opposed cam carriers (4, 5). These cam carriers are independent and are driven individually, for example by notched belts (10, 13) and motors (12, 15). The elimination of the bow of the carriage makes it possible to provide a large number of bars (17 to 22) for yarn guides driven individually. The yarns arrive at the yarn guides along the shortest path, and the working speed can be increased considerably.

1 Claim, 4 Drawing Sheets

FLAT-BED KNITTING MACHINE

This application is a continuation-in-part of patent application Ser. No. 919,550, filed Jul. 22, 1992, now abandoned.

FIELD OF THE INVENTION

The subject of the present invention is a flat-bed knitting machine comprising two knitting beds, at least one pair of opposed cam carriers for driving the needles, means for driving these cam carriers along the sections, a plurality of yarn guides capable of being displaced on bars above the sections, means for driving these yarn guides and means for controlling the displacements of the cam carriers and of the yarn guides.

PRIOR ART

Such a machine is known, for example, from Patent Application EP 0,246,364. In this machine, as in all the known machines, the cam carriers are mounted on a bow-shaped carriage straddling the sections and the striping bars on which the yarn guides are displaced. Such a form of carriage has been used practically since the invention of two-section knitting machines, and it has hitherto been considered an obligatory feature in order to ensure the synchronized displacement of the two cam carriers, despite its disadvantages where a machine for knitting intarsia fabrics is concerned. These disadvantages are that the yarns to be knitted have to be fed to the yarn guides almost horizontally so as not to be in the path of the carriage. To this effect, the yarns must pass over pulleys at one of the ends of the machine. The result of this is that, in one direction of displacement of the carriage, there is a pronounced pull on the yarn, while during the displacement of the carriage in the other direction the yarn has to be drawn back in the other direction so that the slack occurring in the yarn does not cause the yarn to fall onto the sections. These conditions, which have had to be satisfied hitherto, limit the displacement speed of the carriage and the number of yarns of different colors capable of being knitted. Now the current performances of the electronic and mechanical means are such that, without these disadvantages, it would be directly possible to work at a speed substantially higher than the current speed and with more yarns.

In the 1920s, Messrs. Dubied sought to solve this problem by lengthening the carriage bow transversely. The carriage bow extended in the prolongation of the machine, thus considerably increasing the bulk of the machine.

SUMMARY OF THE INVENTION

The object of the present invention is to overcome the abovedescribed disadvantages and to provide a construction making it possible to increase considerably the working speed of the machine and the number of yarns knitted.

The knitting machine according to the invention is defined in that the cam carriers of each pair are independent, and in that they are driven individually and are interdependent.

The knitting machine according to the invention therefore virtually no longer possesses a carriage, and, contrary to preconceived ideas, a synchronization of the cam carriers is perfectly possible without any rigid connection between these cam carriers.

The interdependence of the cam carriers can be ensured by mechanical or electronic means.

Hitherto, a carriage has also seemed necessary for ensuring the transverse alignment of the cam carriers. Now it transpires that the cam carriers do not necessarily have to be aligned transversely, but that it can, on the contrary, be expedient for them to be offset, for example in order to tighten or loosen the stitches, as desired. The knitting machine according to the invention indeed makes it possible to offset the cam carriers as desired. This capability affords tremendous knitting possibilities and gives a very high flexibility of use.

In such a knitting machine, the yarn guides are preferably driven individually, each by its own motor, thereby making it possible to position the yarn guides as desired and hence produce new stitch structures as well as the combination of different structures and intarsia.

BRIEF DESCRIPTION OF THE DRAWING

The accompanying drawing shows one embodiment of the invention by way of example.

DESCRIPTION OF THE PREFERRED EMBODIMENTS

Figure 2:
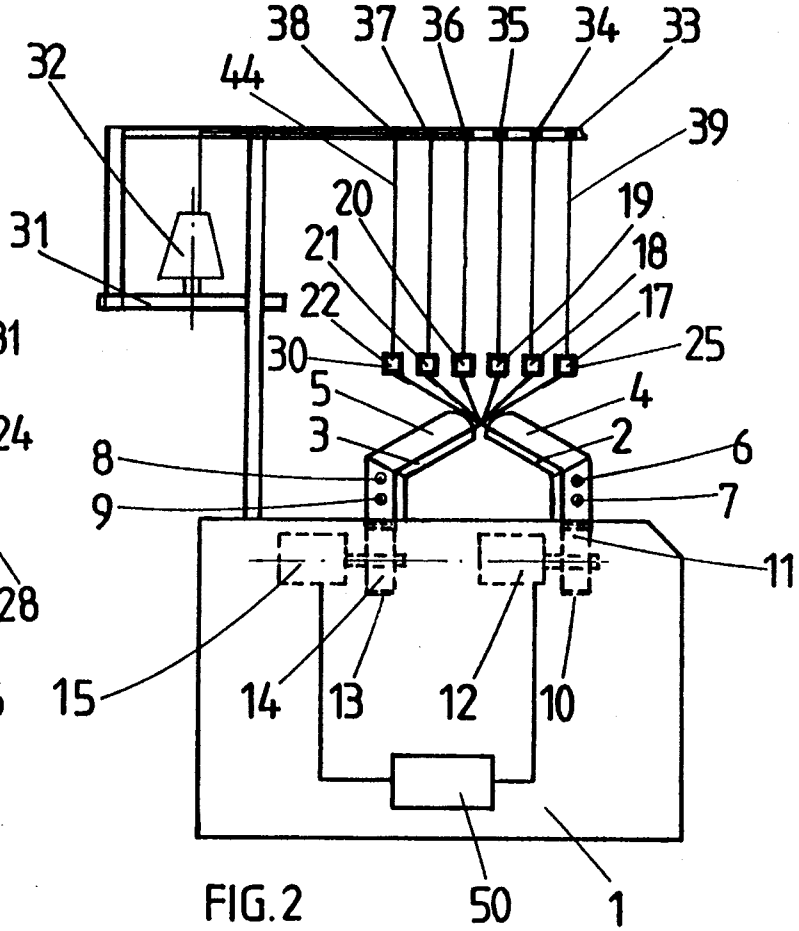
FIG. 2 is a sectional view along II—II of FIG. 1, showing the mechanical means for interdependantly driving the cam carriers.

The knitting machine shown comprises, in the same way as conventional machines, a stand 1 carrying two knitting beds 2 and 3 assembled in a V-shaped manner. Arranged in each of the knitting beds 2 and 3 are needles and jacks, the drive of which is ensured by two cam carriers 4 and 5, of the double-set type in the example under consideration.

In their new design, the cam carriers 4 and 5 are not mounted on a carriage, but are independent. The cam carrier 4 is mounted slideably on two parallel bars 6 and 7. Similarly, the cam carrier 5 is mounted on two cylindrical parallel bars 8 and 9. The cam carrier 4 is attached to a notched belt 10 extending over virtually the entire length of the machine. The notched belt 10 is driven by a gearwheel 11, itself driven by a first electric motor 12. Similarly, the cam carrier 5 is attached to a second notched belt 13 driven by a gearwheel 14, itself driven by a second motor 15. At the other end of the machine, the notched belts pass over pulleys 16. These pulleys can likewise be toothed. So as to have two completely identical notched belts 10 and 13, these belts are preferably obtained by dividing a notched belt lengthwise. The belts obtained are thus completely identical as regards both their shape and their structure. They therefore possess, in particular, the same elasticity characteristics. The motors 12, 15, the gear wheels 11, 14, belts 10, 13 constitute the drive means for the respective cam carriers 4, 5.

Above the knitting beds 2 and 3, a particular number of bars, in the example shown six bars 17, 18, 19, 20, 21, 22, extend parallel to the knitting beds and are carried at their ends by two columns 23 and 24. A yarn guide 25, 26, 27, 28, 29, 30 is mounted slideably on each of these bars 17 to 22, respectively. A yarn catcher, such as 31, is mounted on each yarn guide. Each yarn guide is driven along its bar by means of a small individual electric motor by the agency of a belt or an endless screw (not shown). The elimination of the carriage frees the entire space above the knitting beds, thus making it possible to arrange the bars of the yarn guides freely at the height and with the spacing most suitable for grasping and driving the yarns. It is also directly possible, moreover, to increase the number of bars, that is to say yarn guides, and consequently the number of different yarns capable of being knitted.

Figure 1:
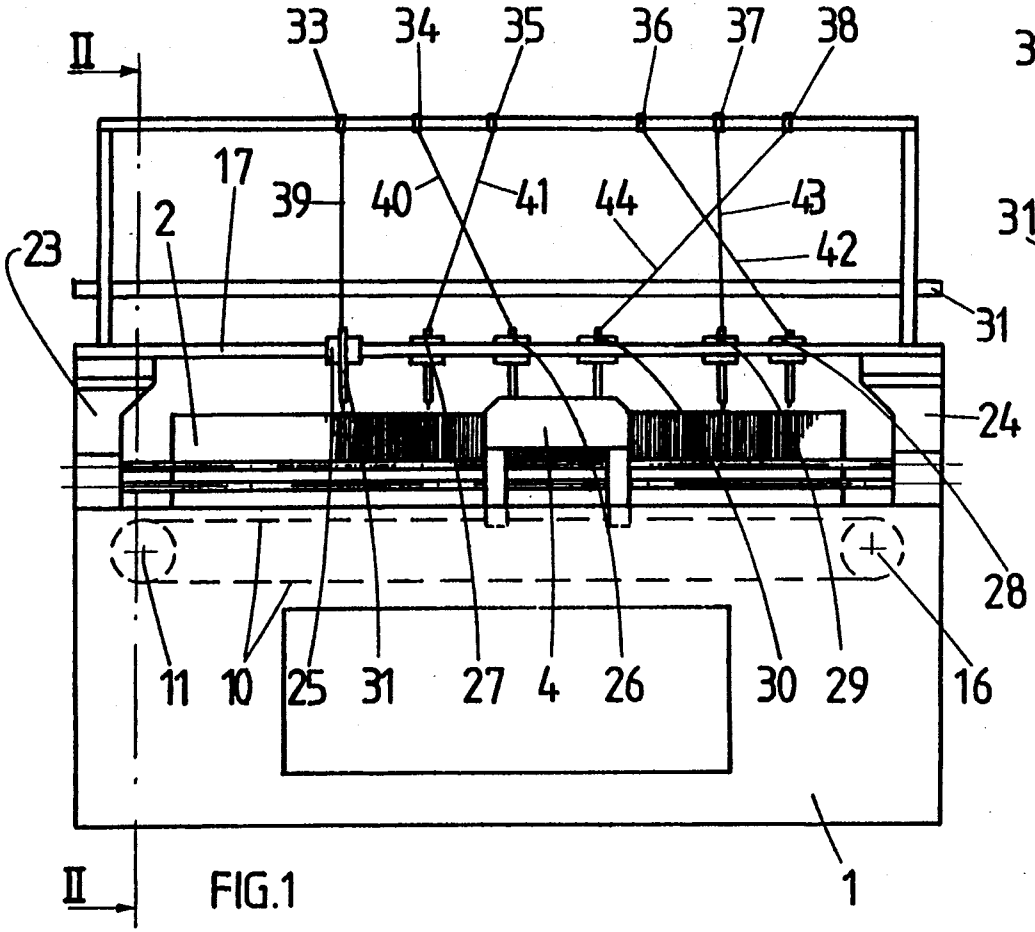
FIG. 1 shows diagrammatically a front view of a knitting machine.

Located in a known way at the rear of the knitting beds is a package support 31', on which six packages, such as the package 32, are mounted. The packages have not been shown in FIG. 1. Yarn pulleys 33, 34, 35, 36, 37, 38 are mounted opposite each of the packages and above each corresponding yarn guide.

Figure 3:
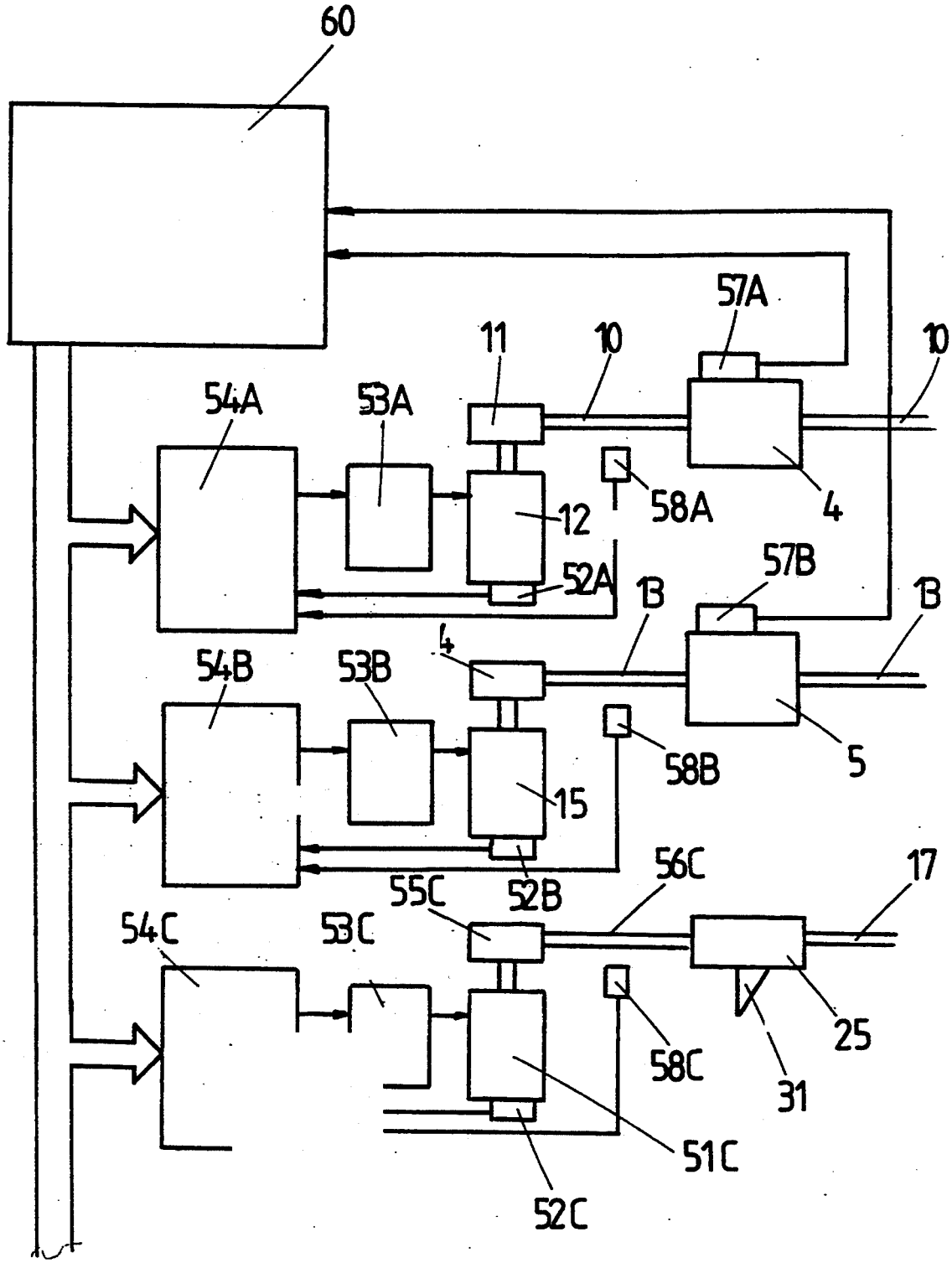
FIG. 3 is a schematic view of the control means of the machine of the FIG. 2.

The two motors 12 and 15 are controlled by a control device 50 represented in detail in FIG. 3.

The control of two servomechanisms or more in dynamic automatic control of position is well known in the field of machine tools (shaping, drawing tables) and of robots. In this type of automatic control the trajectories are described in parametric time form. The controls of the motors are independent and of the position forecasting type with speed feed forward. This type of control can be used in the case of independent cam-carrying carriages as well as for thread-guiding carriages. Such an automatic control system is represented, for memory, in FIG. 3.

The motors 12 and 13 are brushless motors 5 equipped with a position encoder 52A, 52B respectively, and with a three-phase bridge. The motors 12 and 13 are driven by means of a driver 53A, 53B respectively.

A microprocessor 54A, 54B respectively,specialized in the control of the respective motor 12, 15. The motor 12 drives the carriage 4 by means of the toothed wheel 11 and the toothed belt 10. The position of the carriage 4 is detected by means of a magnetic sensor 57A. A reference position zero is fixed by means of a detector 58A. In an identical way, the carriage is driven by its toothed belt 13. It is equipped with a position sensor 57B.

The thread guides 25 to 30 are driven in the same way as the carriages-4 and 5 as indicated for the first thread guide 25 in FIG. 3.

All the microprocessors 54A, 54B, 54C, . . . are connected to a main processor 60 which sets out the control orders to be executed by the various drives. This processor 60 therefore receives the information coming from the magnetic sensors 57A, 57B associated with the carriages 4 and 5.

Before each movement of the carriages 4 and 5 the orders set out by the main processor 60, which orders contain the information necessary to calculate the position with time of these carriages, are sent to the various microprocessors 54A, 54B, 54C . . . On the basis of this information (acceleration, maximum speed, arrival point, starting time), each microprocessor sets out a theoretical position datum which the associated drive will follow over time. To this end, the microprocessor keeps the position of the drive up to date by counting the pulses from the incremental encoder 52A, 52B associated with the motor, compares this position with the datum generated and determines the order and duration of the activation of each phase of the motor.

Since each control is independent, it is therefore possible to produce an offset of one carriage relative to the other carriage. When the carriages are operating, that is to say when they are moving, they are, however controlled by identical datums in time in order to prevent different dynamic behaviors of the belts 10 and 13. The difference in original position will correspond to the phase difference. This phase difference is managed by the main processor 60 which can measure the actual phase of the carriages on the basis of the position of the needles which position is determined by the magneto resistive sensors 57A and 57B. It should be emphasized that these sensors already exist on the machines prior to the present invention for controlling knitting needles. Such a control technique is moreover well known to the person skilled in the art.

The main advantage of the knitting machine shown emerges at once from the drawing. It can be seen that the yarns 39 to 44 go toward each of the yarn guides along the shortest path. Let it be assumed that the cam carriers are displaced in the direction of the arrow. The yarn guides 26 and 30 are driven by their respective motors in synchronization with the displacement of the cam carriers and the yarns 40 and 44 are knitted. There is minimum tension on the yarn 40. To change yarns, it is sufficient to move the knitted yarn out of the path of the needles and to bring another yarn into this path by displacing its yarn guide in a suitable way, for example as described in Patent Application EP 0,415,512.

It becomes possible to work with yarns which are more fragile than current yarns. It is possible to increase considerably the number of bars and of yarn guides, for example to bring this number to twenty, thus making it possible to knit in twenty different colors.

The possibility of offsetting the cam carriers relative to one another as desired affords tremendous knitting possibilities. A small offset makes it possible to tighten or, on the contrary, enlarge stitches. A greater offset should make it possible to convert a single-set machine into a double-set machine. The possibilities afforded are immense.

Figure 4:
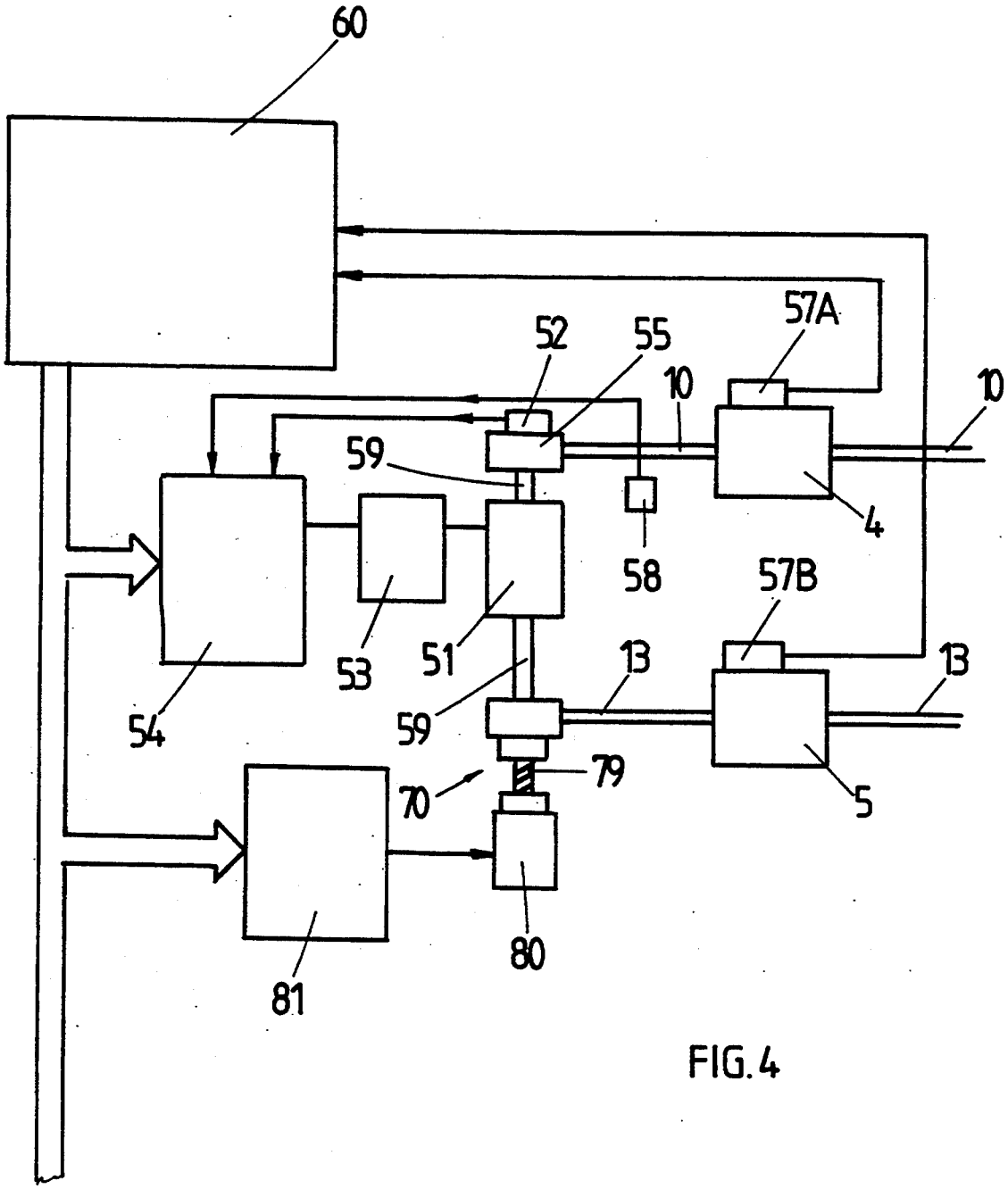
FIG. 4 is a schematic view of the control means in a second embodiment with one single driving motor for both cam carriers.

It is possible to drive the two carriages 4 and 5 by means of a single motor which is common to both carriages. Such an embodiment will be described in relation to FIGS. 4 and 5. The common motor 51 is again a brushless motor controlled by a microprocessor 74 by means of a driver 53. The microprocessor 54 is again controlled via the main processor 60 of the knitting machine. The motor 51 is also equipped with a position encoder 52 and includes a shaft 59 with two outputs. On one side a toothed wheel 55 corresponding to the toothed wheel 11 is keyed onto the shaft 59 and directly drives the belt 10 of the carriage 4. On the other side the shaft 59 drives the toothed belt 13 of the second carriage 5 by means of a phase shifting device 70 controlled by a step by step motor or servomotor 80 controlled by the main processor 60 by means of a driver 81. The thread guides are controlled as before.

Figure 5:
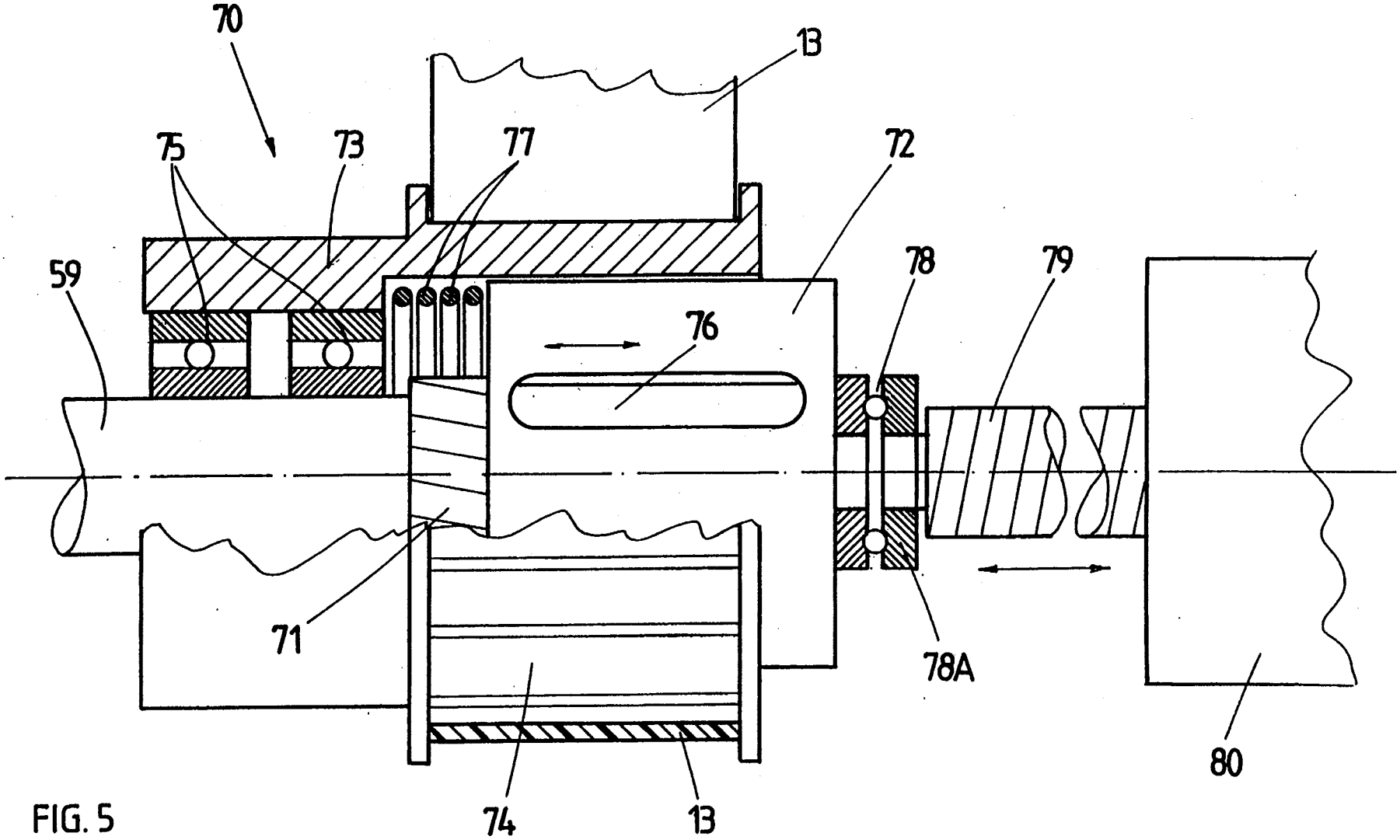
FIG. 5 is a detail view of the phase shift mechanism used in the second embodiment.

The phase shifting device 70 is represented in partial section in FIG. 5. The end of the shaft 59 has helical toothing 71 engaged partially in similar helical toothing of a cylindrical ring 72 mounted so that it can slide axially in a cylindrical sleeve 73 having a toothed part 74 intended to drive the toothed belt 13 of the carriage 5 and therefore corresponding to the toothed wheel 14 of FIG. 2. The sleeve 73 is mounted so that it can rotate on the shaft 59 by means of a double ball bearing 75. The ring 72 is made rotationally integral with the sleeve 73 by keying 76, so that the toothed sleeve 73 is driven by the shaft 59 by means of the ring 72. This ring 72 is furthermore thrust axially by a spring 77 against a thrust ball bearing 78 one of the races 78A of which is fixed to the end of a worm 79 driven by the stepper motor 80 which therefore has the effect of making the worm 79 advance or retract. The axial movement of the worm 79 has the effect of axially moving the ring 72. Due to the helical toothing 71, such an axial movement of the ring 72 has the effect of rotating it, and with it the toothed sleeve 73, and thus of introducing a mechanical phase shift between the sleeve 73 and the toothed wheel 55, that is to say between the toothed belts 10 and 13, that is to say a phase shift between the carriages 4 and 5. The main processor 60 receives the signals coming from the position sensors 57A and 57B associated with each carriage. It is therefore possible to verify whether the phase shift corresponds to the required value and if necessary to correct it by means of the motor 80. A control loop is thus produced. This control loop is characterized by a very low cut off frequency and can in no way compensate for the error in dynamic phase shift due to the deformation of the belts under the effect of the forces for accelerating and braking the carriages. The use of perfectly identical toothed belts obtained, as described above, by splitting a belt and producing identical stressing conditions for each of the belts, however, makes it possible to avoid these mechanical phase shift variations due to the deformations of the belts.

The cam carriers could be driven by other means, for example by means of an endless screw which could replace one of the guide bars.

Each bar could carry two yarn guides, namely one yarn guide on each side of the bar.

The technique described also applies, of course, to a double machine.

I claim:

1. A flat-bed knitting machine comprising several bars and several yarn guides and a yarn guide slidable on each bar, and two knitting beds including needles, at least one pair of displaceable cam carriers above the knitting beds for driving said needles, means for driving said cam carriers along said knitting beds such that the cam carriers are displaceable along said knitting beds, the yarn guides each being displaceable on the bars above said knitting beds, means for driving said yarn guides and means for controlling the displacements of said cam carriers and of said yarn guides, wherein said cam carriers of each pair are independent, and are driven individually while the control means render the cam carriers independent with respect to each other, a space is freed between the carriers above the knitting beds and a yarn path is between yarn packages and yarn guides said plurality of bars with their yarn guides are arranged in the space freed between the carriers above the knitting beds so that the yarn path between yarn packages and yarn guides is at a minimum, the drive means includes notched belts, each of said cam carriers is engaged by a notched belt, the drive means includes a common motor, the notched belts are driven by the common motor, said notched belts are derived by axially cutting a single notched belt, and control means to offset the cam carriers, said control means comprising a first shaft driving a first toothed belt, the end of said first shaft having a helical toothing, a second shaft sleeve shaped driving a second toothed belt, an axially moveable ring with inner helical toothing mounted on said end of the first shaft having an helical toothing, said ring being also mounted within the sleeve shaped second shaft and rotating with said second shaft, and a setting motor to move axially said axially movable ring in order to introduce an angle shift between said shafts.

* * * * *